US008137487B2

(12) United States Patent
Nonaka et al.

(10) Patent No.: US 8,137,487 B2
(45) Date of Patent: Mar. 20, 2012

(54) METHOD OF PRODUCTION OF HIGH STRENGTH THIN-GAUGE STEEL SHEET EXCELLENT IN ELONGATION AND HOLE EXPANDABILITY

(75) Inventors: Toshiki Nonaka, Tokai (JP); Hirokazu Taniguchi, Futtsu (JP); Koichi Goto, Tokai (JP)

(73) Assignee: Nippon Steel Corporation, Tokyo (JP)

( * ) Notice: Subject to any disclaimer, the term of this patent is extended or adjusted under 35 U.S.C. 154(b) by 243 days.

(21) Appl. No.: 12/583,846

(22) Filed: Aug. 27, 2009

(65) Prior Publication Data

US 2009/0314395 A1 Dec. 24, 2009

Related U.S. Application Data

(62) Division of application No. 11/663,581, filed as application No. PCT/JP2005/018724 on Oct. 5, 2005, now abandoned.

(30) Foreign Application Priority Data

Oct. 6, 2004 (JP) ..... 2004-293990

(51) Int. Cl.
*C21D 8/02* (2006.01)
*C21D 8/00* (2006.01)

(52) U.S. Cl. ..... 148/603; 148/651; 148/654

(58) Field of Classification Search ..... 148/603, 148/651, 664, 320
See application file for complete search history.

(56) References Cited

U.S. PATENT DOCUMENTS

| | | | |
|---|---|---|---|
| 6,423,426 | B1 | 7/2002 | Kobayashi et al. |
| 7,090,731 | B2 | 8/2006 | Kashima et al. |

FOREIGN PATENT DOCUMENTS

| | | |
|---|---|---|
| JP | 9-67645 | 3/1997 |
| JP | 2001-3150 | 1/2001 |
| JP | 2001-207235 | 7/2001 |
| JP | 2001-207236 | 7/2001 |
| JP | 2003-231941 | 8/2003 |
| JP | 2004-68050 | 3/2004 |
| KR | 10-2004-0066935 | 7/2004 |
| WO | WO 2004/001084 | 12/2003 |

*Primary Examiner* — Deborah Yee
(74) *Attorney, Agent, or Firm* — Kenyon & Kenyon LLP

(57) ABSTRACT

The present invention provides high strength thin-gauge steel sheet with excellent elongation and hole expandability having a tensile strength of 500 MPa or more and a method of production of high strength thin-gauge steel sheet with excellent elongation and hole expandability enabling production of this on an industrial scale, that is, high strength thin-gauge steel sheet comprised of, by mass %, C: 0.03 to 0.25%, Si: 0.013 to 0.299%, Mn: 0.8 to 3.1%, P≦0.02%, S≦0.02%, Al≦2.0%, N≦0.01%, and a balance of Fe and unavoidable impurities and having a microstructure comprised of ferrite with an area fraction of 10 to 85% and residual austenite with a volume fraction of 1 to 10%, an area fraction of 10% to 60% of tempered martensite, and a balance of bainite.

2 Claims, No Drawings

METHOD OF PRODUCTION OF HIGH STRENGTH THIN-GAUGE STEEL SHEET EXCELLENT IN ELONGATION AND HOLE EXPANDABILITY

This application is a divisional application under 35 U.S.C. §120 and §121 of prior application Ser. No. 11/663,581 filed Mar. 30, 2007 which is a 35 U.S.C. §371 of International Application No. PCT/JP05/18724 filed Oct. 5, 2005, wherein PCT/JP05/18724 was filed and published in the Japanese language.

TECHNICAL FIELD

The present invention relates to high strength thin-gauge steel sheet excellent in elongation and hole expandability and a method of production thereof.

BACKGROUND ART

Recently, due to the need for reducing the weight of automobiles and improving collision safety, high strength steel sheet excellent in formability into chassis frame members and reinforcement members, seat frame parts, and the like are being strongly demanded. From the aesthetic design and chassis design requirements, complicated shapes are sometimes demanded. High strength steel sheet having superior working performance is therefore necessary.

On the other hand, due to the increasingly higher strength of steel sheet, the working method is frequently shifting from the conventional drawing using wrinkle elimination to simple stamping and bending. Especially, when the bending ridge is an arc or other curve, stretch flanging where the end face of the steel sheet is elongated is sometimes used. Further, there are also quite a few parts which are worked by burring to expand a worked hole (preparatory hole) to form a flange. The amount of the expansion in the large case is up to 1.6 times the diameter of the preparatory hole.

On the other hand, the phenomenon of springback or other elastic recovery after working a part occurs more readily the higher the strength of the steel sheet and obstructs securing the precision of the part.

In this way, these working methods require stretch flangeability, hole expandability, bendability, and other local formability of the steel sheet, but conventional high strength steel sheet do not have sufficient performance, cracks and other defects occur, and stable working of the products is not possible.

Therefore, up to now, high strength steel sheet improved in stretch flangeability has been proposed in Japanese Patent Publication (A) No. 9-67645, but there has been a remarkable increase in the need for improvement in workability, in particular hole expandability and therefore further improvement enabling simultaneous improvement in elongation as well.

DISCLOSURE OF INVENTION

The present invention has as its object to solve the problems of the prior art as explained above and realize high strength thin-gauge steel sheet with excellent elongation and hole expandability and a method of production for the same on an industrial scale. Specifically, it has as its object to realize high strength thin-gauge steel sheet exhibiting the above performance by a tensile strength of 500 MPa or more and a method of production of the same on an industrial scale.

The inventors studied the methods of production of high strength thin-gauge steel sheet with excellent elongation and hole expandability and as a result discovered that to further improve the ductility and hole expandability of steel sheet, in the case of high strength cold rolled steel sheet with a tensile strength of steel sheet of 500 MPa or more, the form and balance of the metal structure of the steel sheet and the use of tempered martensite are important. Furthermore, they discovered steel sheet establishing a specific relationship between the tensile strength and Si and Al so as to secure a suitable ferrite area fraction and avoid deterioration of the chemical conversion ability and plating adhesion and controlling precipitates and other inclusions contained inside by the addition of Mg, REM, and Ca so as to improve the local formability and thereby improve the press formability to an unparalleled level and a method of production of the same.

(1) High strength thin-gauge steel sheet with excellent elongation and hole expandability characterized by being comprised of, by mass %, C, 0.03 to 0.25%, Si: 0.013 to 0.299%, Mn: 0.8 to 3.1%, P≦0.02%, S≦0.02%, Al≦2.0%, N≦0.01%, and a balance of Fe and unavoidable impurities and having a microstructure comprised of ferrite with an area fraction of 10 to 85% and residual austenite with a volume fraction of 1 to 10%, an area fraction of 10% to 60% of tempered martensite, and a balance of bainite.

(2) High strength thin-gauge steel sheet with excellent elongation and hole expandability according to (1) characterized by further including as chemical ingredients one or more of V: 0.005 to 1%, Ti: 0.002 to 1%, Nb: 0.002 to 1%, Cr: 0.005 to 2%, Mo: 0.005 to 1%, B: 0.0002 to 0.1%, Mg: 0.0005 to 0.01%, REM: 0.0005 to 0.01%, and Ca: 0.0005 to 0.01%.

(3) High strength thin-gauge steel sheet with excellent elongation and hole expandability according to (1) or (2) characterized by further satisfying the following formula (A):

$$(0.0012\times[TS\text{ target value}]-0.29)/3<[\mathrm{Al}]+0.7[\mathrm{Si}]<1.0 \quad (A)$$

TS target value is design value of strength of steel sheet in units of MPa, [Al] is mass % of Al, and [Si] is mass % of Si, (4) A method of production of high strength thin-gauge steel sheet with excellent elongation and hole expandability characterized by producing a slab comprised of, by mass %, C, 0.03 to 0.25%, Si 0.013 to 0.299%, Mn: 0.8 to 3.1%, P≦0.02%, S≦0.02%, Al≦2.0%, and N≦0.01% and, further, when necessary, one or more types of V: 0.005 to 1%, Ti: 0.002 to 1%, Nb: 0.002 to 1%, Cr: 0.005 to 2%, Mo: 0.005 to 1%, B: 0.0002 to 0.1%, Mg: 0.0005 to 0.01%, REM: 0.0005 to 0.01%, and Ca: 0.0005 to 0.01%, and a balance of Fe and unavoidable impurities, heating it in a range of 1150 to 1250° C., then hot rolling it in a temperature range of 800 to 950° C., coiling it at 700° C. or less, then pickling it as normal, then cold rolling by a reduction rate of 30 to 80%, then, in a continuous annealing process, soaking it at 600° C. to the $Ac_3$ point+50° C. for recrystallization annealing, cooling to 600° C. to the $Ar_3$ point by an average cooling rate of 30° C./s or less, then cooling to 400° C. or less by an average cooling rate of 10 to 150° C./s, then holding at higher than a cooling end temperature of said cooling and 150 to 400° C. for 1 to 20 minutes, then cooling to thereby obtain a metal structure having a microstructure comprised of ferrite with an area fraction of 10 to 85% and residual austenite with a volume fraction of 1 to 10%, an area fraction of 10% to 60% of tempered martensite, and a balance of bainite.

(5) A method of production of high strength thin-gauge steel sheet with excellent elongation and hole expandability according to (4) characterized by, in the continuous annealing process, soaking at 600° C. to the $Ac_3$ point+50° C. for recrystallization annealing, cooling by an average cooling rate of 10 to 150° C./s to 400° C. or less, then heating and holding a first time at 150 to 400° C. for 1 to 20 minutes, then heating and holding a second time at a temperature 30 to 300° C. higher than the first heating and holding temperature to 500° C. for 1 to 100 seconds, then cooling.

(6) A method of production of high strength thin-gauge steel sheet with excellent elongation and hole expandability according to (4) characterized by, in the continuous annealing process, soaking at 600° C. to the $AC_3$ point+50° C. for recrystallization annealing, cooling by an average cooling rate of 10 to 150° C./s to 400° C. or less, then heating and holding a first time at 150 to 400° C. for 1 to 20 minutes, cooling to the martensitic transformation point or less, heating and holding a second time at the cooling end temperature to 500° C. for 1 to 100 seconds, then cooling.

BEST MODE FOR CARRYING OUT THE INVENTION

The biggest characteristic of the structure of a high strength thin-gauge steel sheet according to the present invention is that by performing the necessary heat treatment after an annealing and quenching process, a metal structure containing ferrite, residual austenite, tempered martensite, and bainite in a good balance can be obtained and a material having extremely stable ductility and hole expandability can be obtained.

Next, the limitations of the chemical ingredients of the present invention will be explained.

C is an important element for improving the strengthening and hardenability of the steel and is essential for obtaining a composite structure comprised of ferrite, martensite, bainite, etc. To obtain the bainite or tempered martensite advantageous for obtaining TS≧500 MPa and local formability, 0.03% or more is necessary. On the other hand, if the content becomes greater, the cementite or other iron-based carbides easily become coarser, the local formability deteriorates, and the hardness after welding remarkably rises, so 0.25% was made the upper limit.

Si is an element preferable for raising the strength without lowering the workability of the steel. However, if over 2.0%, due to the rise in the solution strengthening of ferrite, the cold rollability drops and the Si oxides formed at the steel sheet surface cause a drop in the chemical conversion ability. Further, the plating adhesion and weldability also drop, so 2.0% was made the upper limit.

Mn is an element which has to be added from the viewpoint of securing the strength and, further, delaying the formation of carbides and is an element effective for formation of ferrite. If less than 0.8%, the strength is not satisfactory. Further, formation of ferrite becomes insufficient and the ductility deteriorates. If over 3.1%, the martensite becomes excessive, a rise in strength is invited, and the workability deteriorates, so 3.1% was made the upper limit.

P, if over 0.02%, results in remarkable solidification segregation of the time of casting, invites internal cracking and deterioration of the hole expandability, and causes embrittlement of the weld zone, so 0.02% was made the upper limit.

S is a harmful element since it remains as MnS and other sulfide-based inclusions. In particular, the higher the matrix strength, the more remarkable the effect. If the tensile strength is 500 Mpa or more, it should be suppressed to 0.02% or less. However, if Ti is added, precipitation as a Ti-based sulfide occurs, so this restriction is eased somewhat.

Al is an element required for deoxidization of steel, but if over 2.0% increases the alumina and other inclusions and impairs the workability, so 2.0% was made the upper limit. To improve the ductility, addition of 0.2% or more is preferable.

N, if over 0.01%, degrades the aging behavior and workability of the matrix, so 0.01% was made the upper limit.

To obtain high strength steel sheet, generally large amounts of additive elements are necessary and formation of ferrite is restrained. For this reason, the ferrite fraction of the structure is reduced and the fraction of the second phase increases, so especially at 500 MPa or more, the elongation falls. For improvement of this, normally addition of Si and reduction of Mn are frequently used, but the former degrades the chemical conversion ability and plating adhesion, while the latter makes securing the strength difficult, so these cannot be utilized in the steel sheet intended by the present invention. Therefore, the inventors engaged in in-depth studies and as a result discovered the effects of Al and Si. They discovered that when there is a balance of Al, Si, and TS satisfying the relationship of formula (A), a sufficient ferrite fraction can be secured and excellent elongation can be secured.

$$(0.0012\times[TS\text{ target value}]-0.29)/3<[Al]+0.7[Si]<1.0 \quad (A)$$

where the TS target value is the design value of the strength of the steel sheet in units of MPa, [Al] is the mass % of Al, and [Si] is the mass % of Si If the amounts of Al and Si added are (0.0012×[TS target value]-0.29)/3 or less, they are insufficient for improving the ductility, while if 1.0 or more, the chemical conversion ability and plating adhesion deteriorate.

Next, the optional elements of the present invention will be explained.

V, for improving the strength, can be added in the range of 0.005 to 1%.

Ti is an element effective for the purpose of improving the strength and for forming Ti-based sulfides with relatively little effect on the local formability and reducing the harmful MnS. Further, it has the effect of suppressing coarsening of the welded metal structure and making embrittlement difficult. To exhibit these effects, less than 0.002% is insufficient, so 0.002% is made the lower limit. However, if excessively added, the coarse and angular TiN increases and reduces the local formability. Further, stable carbides are formed, the concentration of C in the austenite falls at the time of production of the matrix, the desired hardened structure cannot be obtained, and the tensile strength also can no longer be secured, so 1.0% was made the upper limit.

Nb is an element effective for the purpose of improving the strength and forming fine carbides suppressing softening of the weld heat affected zone. If less than 0.002%, the effect of suppressing softening of the weld heat affected zone cannot be sufficiently obtained, so 0.002% was made the lower limit. On the other hand, if excessively added, the increase in the carbides causes the workability of the matrix to decline, so 1.0% was made the upper limit.

Cr can be added as a strengthening element, but if less than 0.005, has no effect, while if over 2%, degrades the ductility and chemical conversion ability, so 0.005% to 2% was made the range.

Mo is an element which has an effect on securing the strength and on the hardenability and further makes a bainite structure easier to obtain. Further, it also has the effect of suppressing the softening of the weld heat affected zone. Copresence together with Nb etc. is believed to increase this effect. If less than 0.005%, this effect is insufficient, so 0.005% is made the lower limit. However, even if excessively added, the effect becomes saturated and becomes economically disadvantageous, so 1% was made the upper limit.

B is an element having the effect of improving the hardenability of the steel and interacting with C to suppress diffusion of C at the weld heat affected zone and thereby suppress softening. To exhibit this effect, addition of 0.0002% or more is necessary. On the other hand, if excessively added, the workability of the matrix drops and embrittlement of the steel or a drop in the hot workability is caused, so 0.1% was made the upper limit.

Mg bonds with oxygen to form oxides upon addition, but the MgO and the complex compounds of $Al_2O_3$, $SiO_2$, MnO, $Ti_2O_3$, etc. including MgO are believed to precipitate extremely finely. These oxides finely and uniformly dispersed in the steel, while not certain, are believed to have the effect of forming fine voids at the time of stamping or shearing at the stamped or sheared cross-section forming starting points of cracks and suppressing stress concentration at the time of later burring or stretch flanging so as to prevent growth of the cracks to large cracks. Due to this, it becomes possible to improve the hole expandability and stretch flangeability, but if less than 0.0005%, this effect is insufficient, so 0.0005% was made the lower limit. On the other hand, addition over 0.01% not only results in saturation of the amount of improvement with respect to the amount of addition, but also conversely degrades the cleanliness factor of the steel and degrades the hole expandability and stretch flangeability, so 0.01% was made the upper limit.

REM are believed to be elements with a similar effect as Mg. While not sufficiently confirmed, they are believed to be elements promising an improvement in the hole expandability and stretch flangeability due to the effect of suppression of cracks by the formation of fine oxides, but if less than 0.0005%, this effect is insufficient, so 0.0005% was made the lower limit. On the other hand, with addition over 0.01%, not only does the amount of improvement with respect to the added amount become saturated, but also this conversely degrades the cleanliness factor of the steel and degrades the hole expandability and stretch flangeability, so 0.01% was made the upper limit.

Ca has the effect of improving the local formability of the matrix by control of the form of the sulfide-based inclusions (spheroidization), but if less than 0.0005%, the effect is insufficient, so 0.0005% was made the lower limit. Further, if excessively added, not only is the effect saturated, but also the reverse effect due to the increase in inclusions (deterioration of local formability) occurs, so the upper limit was made 0.01%.

In the present invention, the reason for making the structure of the steel sheet a composite structure of ferrite, residual austenite, tempered martensite, and bainite is to obtain steel shape excellent in strength and also elongation and hole expandability. The "ferrite" indicates polygonal ferrite and bainitic ferrite.

Furthermore, in the present invention, the biggest feature in the metal structure of the high strength thin-gauge steel sheet is that the steel contains tempered marensite in an area fraction of 10 to 60%. This tempered martensite is tempered and becomes a tempered martensite structure by heat treatment comprising cooling the martensite formed in the cooling process of the annealing to the martensitic transformation point or less, then holding at 150 to 400° C. for 1 to 20 minutes or by holding at a temperature 50 to 300° C. higher than the holding temperature to 500° C. for 1 to 100 seconds. Here, if the area fraction of the tempered martensite is less than 10%, the hardness difference between the structures will become too large and no improvement in the hole expansion rate will be seen, while if over 60%, the strength of the steel sheet will drop too much. Further, it may be considered that by making the ferrite an area fraction of 10 to 85% and the residual austenite an area fraction of 1 to 10% for a good balance in the steel sheet, the elongation and hole expansion rate would be remarkably improved. If the ferrite area fraction is less than 10%, the elongation cannot be sufficient secured, while if the ferrite area fraction is over 85%, the strength becomes insufficient, so this is not preferable. Moreover, in the process of the present invention, 1% or more residual austenite remains. With over a 10% residual austenite volume fraction, the residual austenite will transform to martensite transformation by working. At that time, voids or a large number of dislocations will occur at the interface of the martensite phase and the surrounding phases. Hydrogen will accumulate at such locations resulting in inferior delayed fracture characteristics, so this is not desirable.

Note that the bainite of the remaining structure can include untempered martensite in an area fraction of 10% or less with respect to the entire structure without any major effect on the quality.

Next, the method of production will be explained.

First, a slab comprised of the above composition of ingredients is produced. The slab is inserted into a heating furnace while at a high temperature or after cooling down to room temperature, heated at a temperature range of 1150 to 1250° C., then hot finished rolled a temperature range of 800 to 950° C. and coiled at 700° C. or less to obtain a hot rolled steel sheet. If the hot rolled final temperature is less than 800° C., the crystal grains become mixed grains and the workability of the matrix is lowered. If over 950° C., the austenite grains become coarse and the desired microstructure cannot be obtained. A lower coiling temperature enables the formation of a pearlite structure to be suppressed, but if considering the cooling load as well, the temperature is preferably made a range of 400 to 600° C.

Next, the sheet is pickled, then cold rolled and annealed to obtain a thin-gauge steel sheet. The cold rolling rate is preferably a range of 30 to 80% in terms of rolling load and material quality.

The annealing temperature is important in securing a predetermined strength and workability of high strength steel sheet and is preferably 600° C. to $Ac_3$+50° C. If less than 600° C., sufficient recrystallization does not occur and the workability of the matrix itself is hard to stably obtain. Further, if over $Ac_3$+50° C., the austenite grains coarsen, formation of ferrite is suppressed, and the desired microstructure becomes hard to obtain. Further, to obtain the microstructure prescribed by the present invention, the method of continuous annealing is preferable.

Next, the sheet is cooled to 600° C. to $Ar_3$ at an average cooling rate of 30° C./s or less to form ferrite. If less than 600° C., pearlite precipitates and the quality degrades, so this is not preferred. If over $Ar_3$, the predetermined ferrite area fraction cannot be obtained. Further, even if the average cooling rate is over 30° C./s, the predetermined ferrite area fraction cannot be obtained, so the average cooling rate was made 30° C./s or less, more preferably 10° C./s or less.

Next, securing tempered martensite with an area fraction of 10% to 60% effective for improving the hole expandability and stretch flangeability more will be explained.

After the above annealing and subsequent cooling, the sheet is cooled by an average cooling rate of 10 to 150° C./s to 400° C. or less. If less than 10° C./s, the majority of the untransformed austenite is transformed to bainite, so the subsequent formation of martensite is not sufficient and the strength becomes inadequate. If over 150° C./s, the shape of the steel sheet is remarkably degraded, so this is not desirable. Further, if over 400° C., the amount of martensite cannot be sufficiently secured and the strength becomes inadequate. To enable efficient production by a production line working the present invention connected to a continuous annealing line, 100 to 400° C. or the martensitic transformation point temperature to 400° C. is preferable. Note that the martensitic transformation point Ms is found by Ms(° C.)=561−471×C(%)−33Mn(%)−17×Ni(%)−17×Cr(%)−21×Mo(%).

Next, the sheet is treated by a heating and holding process in which it is held at a temperature higher than the cooling end temperature of the cooling step and in the range of 150 to 400° C. for 1 to 20 minutes. If less than 150° C., the martensite will not be tempered and the hardness difference between the structures will become large. Further, the bainite transformation will also be insufficient and the predetermined ductility and hole expandability will not be obtained. If over 400°, the sheet will be overly tempered and the strength will fall, so this is not desirable.

Further, to secure tempered martensite in the heating and holding process, the upper limit is preferably made the martensitic transformation point or less.

Further, to secure the bainite in the heating and holding process, the lower limit is preferably over the martensitic transformation point.

If the holding time is less than 1 minute, the tempering and transformation do not progress much at all or remain incomplete, and the ductility and hole expansion rate are not improved. If over 20 minutes, the tempering and transformation substantially end, so there is no effect even with extending the time.

Note that the heating and holding process may be one connected to the continuous annealing line or may be a separate line, but one connected to the continuous annealing facility or one performed in an averaging oven of the continuous annealing line is preferable in terms of productivity.

Further, to reliably secure bainite, then secure tempered martensite, it is preferable to make the above heating and holding process a first heating and holding process of heating and holding at 150 to 400° C. and holding for 1 to 20 minutes, then a second heating and holding process of heating to a temperature 30 to 300° C. higher than the holding temperature of the first heating and holding process to 500° C. for 1 to 100 seconds, then cooling.

If the temperature of the second heating and holding process is less than the holding temperature of the first heating and holding process+30° C., the martensite is not tempered, the hardness difference between the structures becomes large, and the predetermined ductility and hole expandability cannot be obtained. If the temperature of the second heating and holding process is over the holding temperature of the first heating and holding process+300° C., the sheet will be overly tempered and the strength will fall, so this is not preferable.

If the holding time is less than 1 second, the tempering will not proceed much at all or will remain incomplete and the ductility and hole expansion rate will not be improved. If over 100 seconds, the tempering substantially ends, so there is no effect even with extending the time.

Further, to reliably secure bainite, then convert the untransformed austenite to martensite and secure tempered martensite, it is preferable to make the heating and holding process a first heating and holding process of heating and holding at 150 to 400° C. and holding for 1 to 20 minutes, then cooling to the martensitic transformation point or less, holding at the cooling end temperature to 500° C. for 1 to 100 seconds for second heating and holding, then cooling. If the temperature of the second heating and holding process is made the cooling end temperature when cooling to the martensitic transformation point or less+50 to 300° C. to 500° C. or less, tempered martensite can be reliably secured, so this is preferable.

If the temperature of the second heating and holding process is less than the cooling end temperature, the martensite will not be tempered, the hardness difference between the structures will become large, and the predetermined ductility and hole expandability cannot be obtained. The lower limit of the temperature of the second heating and holding process is more preferably the cooling end temperature+50° C. and the martensitic transformation point or more. If the cooling end temperature+300° C., it is more preferable. If the temperature of the second heating and holding process is over 500° C., the sheet is overly tempered and the strength drops, so this is not preferable.

When the holding time is less than 1 second, the tempering does not progress much at all or remains incomplete and the ductility and hole expanding rate are not improved. If over 100 seconds, the tempering substantially ends, so there is no effect even with extending the time.

Further, the steel sheet may also be cold rolled steel sheet or plated steel sheet. Further, the plating may be ordinary galvanization, aluminum plating, etc. The plating may be either hot dipping or electroplating. Further, the steel sheet may be plated, then alloyed. It may also be plated by multiple layers. Further, even steel sheet comprised of non-plated steel sheet or plated steel sheet on which a film is laminated is not outside the present invention.

EXAMPLES

Steel of each of the composition of ingredients shown in Table 1 was produced in a vacuum melting furnace, cooled to solidify, then reheated to 1200 to 1240° C., final rolled at 880 to 920° C. (to sheet thickness of 2.3 mm), cooled, then held at 600° C. for 1 hour so as to reproduce the coiling heat treatment of the hot rolling. The obtained hot rolled sheet was descaled by grinding, cold rolled (to 1.2 mm), then annealed at 750 to 880° C.×75 seconds using a continuous annealing simulator.

After this, the sheet was cooling, heated, and held under the conditions of [8] (comparative example) and [2] and [6] (invention examples) of Table 2.

Furthermore, the steel type G described in Table 1 was used for comparison while changing the heating and holding conditions of the annealing by the conditions of and [5] (invention examples) and [3], [4], and [7] (comparative examples) of Table 2.

TABLE 1

| Steel type | TS target value | C | Si | Mn | P | S | Al | N | Mg | Ti | Nb | V | Cr | Mo | B |
|---|---|---|---|---|---|---|---|---|---|---|---|---|---|---|---|
| A | 590 | 0.058 | 0.171 | 2.06 | 0.016 | 0.007 | 0.970 | 0.003 | | 0.010 | 0.015 | | 0.020 | 0.110 | |
| B | 590 | 0.058 | 0.160 | 1.10 | 0.019 | 0.002 | 0.896 | 0.008 | | | | | | | |
| C | 600 | 0.071 | 0.196 | 1.42 | 0.017 | 0.003 | 0.547 | 0.005 | 0.0011 | 0.029 | | | | 0.160 | 0.0008 |
| D | 650 | 0.082 | 0.089 | 1.15 | 0.016 | 0.004 | 1.139 | 0.005 | | | | 0.026 | | 0.089 | |
| E | 690 | 0.082 | 0.081 | 2.63 | 0.019 | 0.001 | 1.049 | 0.003 | | | | | | | |

TABLE 1-continued

| | | | | | | | | | | | | | | | |
|---|---|---|---|---|---|---|---|---|---|---|---|---|---|---|---|
| F | 710 | 0.093 | 0.055 | 1.84 | 0.007 | 0.006 | 0.500 | 0.007 | | | 0.010 | | | 0.280 | |
| G | 780 | 0.100 | 0.013 | 1.10 | 0.002 | 0.008 | 0.815 | 0.004 | | 0.022 | 0.017 | | | 0.210 | 0.0009 |
| H | 800 | 0.110 | 0.122 | 2.64 | 0.018 | 0.009 | 0.731 | 0.020 | | | | | | | |
| I | 820 | 0.120 | 0.084 | 1.17 | 0.010 | 0.010 | 0.866 | 0.004 | 0.0022 | | | | | 0.130 | |
| J | 860 | 0.120 | 0.148 | 1.19 | 0.016 | 0.008 | 1.000 | 0.006 | | 0.045 | | | 0.033 | 0.210 | |
| K | 920 | 0.134 | 0.047 | 1.19 | 0.016 | 0.010 | 1.114 | 0.007 | 0.0033 | | | 0.032 | | 0.052 | |
| L | 940 | 0.140 | 0.042 | 1.71 | 0.014 | 0.006 | 0.780 | 0.005 | | | 0.020 | | | | |
| M | 970 | 0.142 | 0.116 | 1.27 | 0.018 | 0.007 | 0.850 | 0.006 | | | | 0.015 | 0.021 | | 0.0008 |
| N | 1000 | 0.150 | 0.107 | 1.76 | 0.019 | 0.006 | 0.880 | 0.009 | | | | | | | |
| O | 1210 | 0.150 | 0.107 | 2.65 | 0.059 | 0.006 | 0.880 | 0.009 | | | 0.012 | | | 0.150 | |
| P | 1230 | 0.195 | 0.299 | 1.20 | 0.019 | 0.005 | 0.600 | 0.002 | 0.0041 | | | | | | 0.0010 |
| Q | 1500 | 0.196 | 0.187 | 1.95 | 0.018 | 0.004 | 0.019 | 0.009 | | | | | | 0.150 | |
| a | 450 | 0.025 | 0.177 | 1.11 | 0.016 | 0.009 | 0.953 | 0.005 | | | | 0.021 | | 0.020 | 0.0007 |
| b | 1350 | 0.255 | 0.176 | 2.73 | 0.018 | 0.008 | 0.850 | 0.004 | 0.0020 | | 0.019 | | | 0.150 | |
| c | 970 | 0.090 | 2.050 | 2.70 | 0.015 | 0.003 | 0.040 | 0.004 | | 0.001 | | | | | 0.0008 |
| d | 1500 | 0.193 | 0.220 | 2.53 | 0.005 | 0.003 | 2.030 | 0.002 | | | | | 0.031 | 0.023 | |

| Steel type | REM | Ca | [Al] + 0.7[Si] | Formula (A) left side | Left side judgement | Formula (A) right side | Right side judgement | Sheet thickness (mm) | Class |
|---|---|---|---|---|---|---|---|---|---|
| A | | | 1.0897 | 0.1393 | Good | 1.0 | Poor | 1.2 | Inv. range |
| B | | | 1.0080 | 0.1393 | Good | 1.0 | Poor | 1.4 | Inv. range |
| C | | 0.0010 | 0.6842 | 0.1433 | Good | 1.0 | Good | 1.2 | Inv. range |
| D | 0.0007 | 0.0008 | 1.2013 | 0.1633 | Good | 1.0 | Poor | 1.0 | Inv. range |
| E | | | 1.1057 | 0.1793 | Good | 1.0 | Poor | 0.8 | Inv. range |
| F | | | 0.5385 | 0.1873 | Good | 1.0 | Good | 1.6 | Inv. range |
| G | | | 0.8241 | 0.2153 | Good | 1.0 | Good | 1.4 | Inv. range |
| H | | | 0.8164 | 0.2233 | Good | 1.0 | Good | 3.4 | Inv. range |
| I | | | 0.9248 | 0.2313 | Good | 1.0 | Good | 1.4 | Inv. range |
| J | | | 1.1036 | 0.2473 | Good | 1.0 | Poor | | Inv. range |
| K | | | 1.1469 | 0.2713 | Good | 1.0 | Poor | | Inv. range |
| L | | 0.0012 | 0.8094 | 0.2793 | Good | 1.0 | Good | | Inv. range |
| M | | | 0.9312 | 0.2913 | Good | 1.0 | Good | | Inv. range |
| N | | | 0.9549 | 0.3033 | Good | 1.0 | Good | | Inv. range |
| O | 0.0012 | 0.0013 | 0.9549 | 0.3873 | Good | 1.0 | Good | | Inv. range |
| P | | | 0.8093 | 0.3953 | Good | 1.0 | Good | | Inv. range |
| Q | | | 0.1499 | 0.5033 | Poor | 1.0 | Good | | Inv. range |
| a | | 0.0008 | 1.0769 | 0.0833 | Good | 1.0 | Poor | 1.2 | Comp. Ex. |
| b | | | 0.9732 | 0.4433 | Good | 1.0 | Good | | Comp. Ex. |
| c | | 0.0010 | 1.4750 | 0.2913 | Good | 1.0 | Poor | | Comp. Ex. |
| d | | | 2.1840 | 0.5033 | Good | 1.0 | Poor | | Comp. Ex. |

TABLE 2

| | Average | | First heating and holding | | | | Second heating and holding | | | Temper | |
|---|---|---|---|---|---|---|---|---|---|---|---|
| Experiment no. | cooling rate (° C./s) | Cooling end temp. (° C.) | Temp. (° C.) | Holding time (min) | Cooling temp. (° C.) | Cooling | Temp. (° C.) | Holding time (s) | Cooling temp. (° C.) | rolling rate (%) | |
| [1] | 150 | 300 | 330 | 3 | Room temp. | — | — | — | — | 1 | Inv. Ex. |
| [2] | | 120 | 330 | 3 | Room temp. | — | — | — | — | | Inv. Ex. |
| [3] | | 120 | 120 | 3 | Room temp. | — | — | — | — | | Comp. Ex. |
| [4] | | 120 | 620 | 3 | Room temp. | — | — | — | — | | Comp. Ex. |
| [5] | | 300 | 300 | 3 | Room temp. | Ms point or less | 380 | 30 | Room temp. | | Inv. Ex. |
| [6] | | 120 | 300 | 3 | Room temp. | Ms point or less | 380 | 30 | Room temp. | | Inv. Ex. |
| [7] | | 300 | 300 | 3 | Room temp. | Ms point or less | 620 | 30 | Room temp. | | Comp. Ex. |
| [8] | | 80 | — | — | — | — | — | — | — | | Comp. Ex. |
| [9] | | 300 | 300 | 3 | Room temp. | — | 380 | 30 | Room temp. | | Inv. Ex. |

Note that the various test methods used in the present invention are as shown below.

Tensile characteristics: Evaluated by running tensile test in direction perpendicular to rolling direction of JIS No. 5 tensile test piece Hole expansion rate: Hole expansion test method of Japan Iron and Steel Federation standard JFST1001-1996 employed.

A conical punch with a 60° apex angle was forced through a ϕ10 mm punched hole (die inside diameter of 10.3 mm, clearance 12.5%) to form a burr of the hole in the outside direction by a speed of 20 mm/min:

$$\text{Hole expansion rate } \lambda(\%)=\{(D-Do)/Do\}\times 100$$

D: Hole diameter when crack penetrates sheet thickness

Do: Initial hole diameter (10 mm)

Metal Structure:

Ferrite area fraction: Ferrite observed by Nital etching.

The ferrite area fraction is quantified by polishing a sample by Nital etching (alumina finish), dipping it in corrosive solution (mixture of pure water, sodium pyrosulfite, ethyl alcohol, and picric acid) for 10 seconds, then polishing again, rinsing, then drying the sample by cooling air. After drying, a 100 μm×100 μm area of the structure of the sample is measured for area by a Luzex system at a power of 1000 to determine the area % of the ferrite. In each table, this ferrite area fraction is shown as the ferrite area %.

Tempered Martensite

Area rate: Observation by optical microscope and observation of martensite by LePera etching.

The tempered martensite area fraction is quantified by polishing a sample by LePera etching (alumina finish), dipping it in corrosive solution (mixture of pure water, sodium pyrosulfite, ethyl alcohol, and picric acid) for 10 seconds, then polishing again, rinsing, then drying the sample by cooling air. After drying, a 100 μm×100 μm area of the structure of the sample is measured for area by a Luzex system at a power of 1000 to determine the area % of the tempered martensite. In each table, this tempered martensite area fraction is shown as the tempered martensite area %.

Residual austenite volume fraction: The residual austenite is quantized by MoKα beams from the (200), (210) area strength of the ferrite and the (200), (220), and (311) area strength of the austenite at the surface of the supplied sheet chemically polished to ¼ the thickness from the surface and used as the residual austenite volume fraction. A residual austenite volume fraction of 1 to 10% or more is deemed good.

In each table, the residual austenite volume fraction is expressed as the residual γ-volume % and rate.

The test results of comparative examples of Experiment No. [8] shown in Table 2 of Example 1 are shown in Table 3. Further, the test results of Experiment No. [2] of the present invention are shown in Table 4, those of Experiment No. [6] are shown in Table 5, and those of Experiment No. [9] are shown in Table 6. Further, the test results of Example 2 are shown in Table 7.

Example 1

Comparing Experiment No. [8] with the same operating conditions as the past as a comparative example and Experiment Nos. [2], [6], and [9] of invention examples, it is learned that the invention examples exhibit better values of the hole expansion rate and elongation.

Further, as a comparison of sheets with the same level of tensile strength and generally the same ingredients, but satisfying formula (A) and not satisfying it, among the steel types B and C, E and F, and K and L, the C, F, and L satisfying formula (A) exhibited larger ferrite area fractions and better elongation.

Example 2

Further changing and comparing the tempering conditions, the drop in strength was large and the elongation also conversely dropped. The drop in elongation is believed due to the formation of pearlite. Experiment Nos. [1], [2], [5], [6], and [9] of the invention examples all exhibited good results.

TABLE 3

(Example 1)
Experiment No. [8] (Comparative Examples)
Underlined, bold-face, italics indicate rejection

| Steel type | TS (MPa) | EL (%) | TS × EL | Hole expansion rate | Ferrite area (%) | Residual γ vol. (%) | Tempered martensite area (%) | Other composition | Class |
|---|---|---|---|---|---|---|---|---|---|
| A | 598 | 30.9 | 18478 | 41 | 81.8 | 3.6 | ≦0.1 | Mainly | Comp. Ex. |
| B | 602 | 30.2 | 18180 | 40 | 84.1 | 2.9 | ≦0.1 | martensite | Comp. Ex. |
| C | 613 | 32.3 | 19800 | 40 | 84.3 | 3.6 | ≦0.1 | | Comp. Ex. |
| D | 665 | 29.2 | 19418 | 38 | 73.0 | 2.7 | ≦0.1 | | Comp. Ex. |
| E | 703 | 27.1 | 19051 | 38 | 62.1 | 3.7 | ≦0.1 | | Comp. Ex. |
| F | 722 | 28.6 | 20649 | 38 | 66.8 | 2.7 | ≦0.1 | | Comp. Ex. |
| G | 799 | 24.7 | 19735 | 38 | 59.3 | 3.3 | ≦0.1 | | Comp. Ex. |
| H | 811 | 23.6 | 19140 | 37 | 58.6 | 2.9 | ≦0.1 | | Comp. Ex. |
| I | 836 | 21.8 | 18225 | 34 | 57.1 | 3.1 | ≦0.1 | | Comp. Ex. |
| J | 875 | 20.7 | 18113 | 33 | 52.3 | 2.7 | ≦0.1 | | Comp. Ex. |
| K | 931 | 19.6 | 18248 | 33 | 37.7 | 4 | ≦0.1 | | Comp. Ex. |
| L | 956 | 20.5 | 19598 | 32 | 44.3 | 3.4 | ≦0.1 | | Comp. Ex. |
| M | 984 | 18.8 | 18499 | 30 | 35.5 | 3.6 | ≦0.1 | | Comp. Ex. |
| N | 1021 | 18.3 | 18684 | 27 | 32.5 | 2.9 | ≦0.1 | | Comp. Ex. |
| O | 1223 | 14.6 | 17856 | 24 | 28.3 | 2.8 | ≦0.1 | | Comp. Ex. |
| P | 1243 | 14.4 | 17899 | 22 | 29.4 | 3.4 | ≦0.1 | | Comp. Ex. |
| Q | 1521 | 14.2 | 21598 | 20 | 21.5 | 3.1 | ≦0.1 | | Comp. Ex. |
| a | 453 | 31.2 | 14134 | 62 | 87.1 | 1.8 | ≦0.1 | Mainly | Comp. Ex. |
| b | 1367 | 11.6 | 15857 | 19 | 26.4 | 2.4 | ≦0.1 | martensite | Comp. Ex. |
| c | 985 | 16.0 | 15760 | 27 | 30.2 | 2.3 | ≦0.1 | | Comp. Ex. |
| d | 1523 | 9.7 | 14773 | 18 | 19.8 | 3.1 | ≦0.1 | | Comp. Ex. |

TABLE 4

Experiment No. [2] (Invention) Underlined, bold-face, italics indicate rejection

| Steel type | TS (MPa) | EL (%) | TS × EL | Hole expansion rate | Ferrite area (%) | Residual γ vol. (%) | Tempered martensite area (%) | Other composition | Class |
|---|---|---|---|---|---|---|---|---|---|
| A | 568 | 33.1 | 18783 | 74 | 80.2 | 4.1 | 12.3 | Mainly | Inv. |
| B | 572 | 32.0 | 18308 | 72 | 80.7 | 3.2 | 13.6 | bainite | Inv. |
| C | 582 | 35.2 | 20503 | 72 | 82.6 | 4.4 | 15.4 | | Inv. |
| D | 632 | 31.2 | 19738 | 69 | 70.1 | 3.1 | 19.8 | | Inv. |
| E | 668 | 28.7 | 19185 | 68 | 60.9 | 4.1 | 20.4 | | Inv. |
| F | 686 | 31.2 | 21382 | 68 | 64.1 | 3.3 | 22.1 | | Inv. |
| G | 759 | 26.4 | 20061 | 68 | 58.1 | 3.8 | 25.8 | | Inv. |
| H | 770 | 25.0 | 19274 | 66 | 56.3 | 3.2 | 29.4 | | Inv. |
| I | 794 | 23.8 | 18872 | 61 | 55.9 | 3.8 | 30.9 | | Inv. |
| J | 831 | 22.1 | 18411 | 56 | 50.2 | 3.1 | 34.1 | | Inv. |
| K | 884 | 20.8 | 18375 | 56 | 36.9 | 4.4 | 37 | | Inv. |
| L | 908 | 22.3 | 20294 | 55 | 42.6 | 4.1 | 38.6 | | Inv. |
| M | 935 | 20.1 | 18804 | 51 | 34.8 | 4.1 | 42.7 | | Inv. |
| N | 990 | 19.4 | 19211 | 46 | 31.2 | 3.2 | 45.9 | | Inv. |
| O | 1162 | 15.9 | 18490 | 40 | 21.8 | 3.4 | 47.7 | | Inv. |
| P | 1181 | 15.4 | 18195 | 38 | 28.8 | 3.9 | 49.3 | | Inv. |
| Q | 1445 | 15.1 | 21749 | 34 | 20.6 | 3.4 | 52.9 | | Inv. |
| a | 430 | 34.0 | 14635 | 86 | 85.4 | 2.2 | 8.9 | Mainly | Comp. Ex. |
| b | 1299 | 12.4 | 16119 | 28 | 25.3 | 2.8 | 55.7 | bainite | Comp. Ex. |
| c | 936 | 17.0 | 15870 | 41 | 29.6 | 2.6 | 49.6 | | Comp. Ex. |
| d | 1447 | 10.6 | 15298 | 26 | 19.0 | 3.8 | 62.3 | | Comp. Ex. |

TABLE 5

Experiment No. [6] (Invention) Underlined, bold-face, italics indicate rejection

| Steel type | TS (MPa) | EL (%) | TS × EL | Hole expansion rate | Ferrite area (%) | Residual γ vol. (%) | Tempered martensite area (%) | Other composition | Class |
|---|---|---|---|---|---|---|---|---|---|
| A | 540 | 35.4 | 19093 | 85 | 77.7 | 4.7 | 13.8 | Mainly | Inv. |
| B | 549 | 33.9 | 18630 | 84 | 76.7 | 3.7 | 15.5 | bainite | Inv. |
| C | 542 | 38.4 | 20784 | 84 | 79.3 | 5.4 | 17.4 | | Inv. |
| D | 600 | 33.4 | 20064 | 79 | 68.0 | 3.5 | 22.2 | | Inv. |
| E | 641 | 30.4 | 19522 | 79 | 57.8 | 4.8 | 23.3 | | Inv. |
| F | 638 | 34.0 | 21675 | 79 | 61.6 | 4.0 | 25.0 | | Inv. |
| G | 721 | 28.3 | 20392 | 78 | 56.4 | 4.3 | 28.9 | | Inv. |
| H | 740 | 26.5 | 19613 | 77 | 53.5 | 3.7 | 33.5 | | Inv. |
| I | 739 | 25.9 | 19130 | 71 | 53.7 | 4.6 | 34.9 | | Inv. |
| J | 790 | 23.7 | 18715 | 65 | 48.7 | 3.5 | 38.2 | | Inv. |
| K | 849 | 22.0 | 18699 | 66 | 35.1 | 5.2 | 42.2 | | Inv. |
| L | 845 | 24.4 | 20572 | 64 | 40.9 | 5.1 | 43.6 | | Inv. |
| M | 888 | 21.5 | 19115 | 59 | 33.7 | 4.7 | 47.8 | | Inv. |
| N | 951 | 20.6 | 19549 | 54 | 29.6 | 3.7 | 52.3 | | Inv. |
| O | 1081 | 17.3 | 18743 | 47 | 20.9 | 4.2 | 53.9 | | Inv. |
| P | 1122 | 16.5 | 18495 | 44 | 27.9 | 4.4 | 55.2 | | Inv. |
| Q | 1387 | 16.0 | 22132 | 40 | 19.6 | 4.0 | 60.0 | | Inv. |
| a | 400 | 37.1 | 14836 | 89 | 82.0 | 2.7 | 9.8 | Mainly | Comp. Ex. |
| b | 1234 | 13.3 | 16385 | 30 | 24.6 | 3.1 | 60.7 | bainite | Comp. Ex. |
| c | 898 | 18.0 | 16150 | 42 | 28.2 | 3.0 | 55.6 | | Comp. Ex. |
| d | 1346 | 11.5 | 15507 | 29 | 18.3 | 4.6 | 67.9 | | Comp. Ex. |

TABLE 6

Experiment No. [9] (Invention) Underlined, boldface, italics indicate rejection

| Steel type | TS (MPa) | EL (%) | TS × EL | Hole expansion rate | Ferrite area (%) | Residual γ vol. (%) | Tempered martensite area (%) | Other composition | Class |
|---|---|---|---|---|---|---|---|---|---|
| A | 528 | 35.7 | 18866 | 77 | 76.9 | 4.6 | 12.9 | Mainly bainite | Inv. |
| B | 543 | 34.3 | 18610 | 75 | 75.9 | 3.7 | 14.1 | | Inv. |
| C | 536 | 38.7 | 20749 | 74 | 78.5 | 5.3 | 15.9 | | Inv. |
| D | 588 | 33.7 | 19825 | 72 | 67.3 | 3.4 | 20.8 | | Inv. |
| E | 634 | 30.7 | 19501 | 70 | 57.2 | 4.7 | 21.2 | | Inv. |
| F | 631 | 34.3 | 21639 | 70 | 60.9 | 4.0 | 22.8 | | Inv. |
| G | 706 | 28.5 | 20149 | 71 | 55.8 | 4.2 | 27.1 | | Inv. |
| H | 732 | 26.8 | 19592 | 69 | 52.9 | 3.7 | 30.6 | | Inv. |
| I | 731 | 26.1 | 19098 | 63 | 53.1 | 4.5 | 31.8 | | Inv. |
| J | 773 | 23.9 | 18492 | 59 | 48.2 | 3.4 | 35.8 | | Inv. |
| K | 840 | 22.2 | 18679 | 58 | 34.7 | 5.1 | 38.5 | | Inv. |
| L | 836 | 24.6 | 20537 | 57 | 40.4 | 5.0 | 39.8 | | Inv. |
| M | 869 | 21.7 | 18887 | 54 | 33.4 | 4.6 | 44.8 | | Inv. |
| N | 941 | 20.8 | 19528 | 48 | 29.3 | 3.7 | 47.7 | | Inv. |
| O | 1069 | 17.5 | 18712 | 42 | 20.7 | 4.1 | 49.1 | | Inv. |
| P | 1098 | 16.6 | 18275 | 40 | 27.6 | 4.3 | 51.8 | | Inv. |
| Q | 1373 | 16.1 | 22108 | 35 | 19.4 | 3.9 | 55.0 | | Inv. |
| a | 396 | 37.4 | 14811 | 87 | 81.1 | 2.6 | 9.2 | Mainly bainite | Comp. Ex. |
| b | 1208 | 14.0 | 16939 | 29 | 24.3 | 3.0 | 56.8 | | Comp. Ex. |
| c | 889 | 19.0 | 16886 | 41 | 27.9 | 2.9 | 51.6 | | Comp. Ex. |
| d | 1331 | 12.3 | 16326 | 27 | 18.1 | 4.5 | 64.2 | | Comp. Ex. |

TABLE 7

(Example 2)
The effects of the operational conditions will be seen by the Steel Type G.

| Exp. no. | TS (MPa) | EL (%) | TS × EL | Hole expansion rate | Ferrite area (%) | Residual γ vol. (%) | Tempered martensite area (%) | Other composition | Class |
|---|---|---|---|---|---|---|---|---|---|
| [1] | 791 | 24.8 | 19617 | 52 | 45.0 | 4.0 | 21.3 | Mainly bainite | Inv. Ex. |
| [2] | 759 | 26.4 | 20061 | 68 | 58.1 | 3.8 | 25.8 | | Inv. Ex. |
| [3] | 806 | 23.9 | 19263 | 45 | 45.5 | 3.0 | 3.2 | | Comp. Ex. |
| [4] | 697 | 19.9 | 13870 | 49 | 40.8 | 3.8 | 28.3 | | Comp. Ex. |
| [5] | 766 | 27.4 | 20988 | 56 | 44.2 | 3.6 | 25.3 | | Inv. Ex. |
| [6] | 721 | 28.3 | 20392 | 78 | 56.4 | 4.3 | 28.9 | | Inv. Ex. |
| [7] | 691 | 19.7 | 13613 | 48 | 41.2 | 5.1 | 27.9 | | Comp. Ex. |
| [8] | 799 | 22.8 | 18217 | 45 | 46.7 | 3.3 | ≦0.1 | | Comp. Ex. |
| [9] | 706 | 28.5 | 20149 | 71 | 55.8 | 4.2 | 27.1 | | Inv. Ex. |

INDUSTRIAL APPLICABILITY

According to the present invention, it is possible to provide high strength thin-gauge steel sheet with excellent elongation and hole expandability used for auto parts etc. and a method of production of the same and has extremely great industrial value.

The invention claimed is:

1. A method of production of high strength thin-gauge steel sheet with excellent elongation and hole expandability characterized by, producing a slab comprised of by mass %, C: 0.03 to 0.25%, Si: 0.013 to 0.299%, Mn: 0.8 to 3.1%, P≦0.02%, S≦0.02%, Al≦2.0%, and N≦0.01% and, further, when necessary, one or more types of V: 0.005 to 1%, Ti: 0.002 to 1%, Nb: 0.002 to 1%, Cr: 0.005 to 2%, Mo: 0.005 to 1%, B: 0.0002 to 0.1%, Mg: 0.0005 to 0.01%, REM: 0.0005 to 0.01%, and Ca: 0.0005 to 0.01%, and a balance of Fe and unavoidable impurities, followed by heating to a range of 1150 to 1250° C., then hot rolling in a temperature range of 800 to 950° C., coiling at 700° C. or less, then pickling, then cold rolling by a reduction rate of 30 to 80%, then in a continuous annealing process, soaking at 600° C. to the $Ac_3$ point+50° C. for recrystallization annealing, cooling by an average cooling rate of 10 to 150° C./s to a cooling end temperature of 400° C. or less, then heating and holding at a first holding temperature within the range of 150 to 400° C. and higher than the cooling end temperature for 1 to 20 minutes, then heating and holding at a second holding temperature of 30 to 300° C. higher than the first holding temperature and up to 500° C. for 1 to 100 seconds, then cooling, to thereby obtain a metal structure having a microstructure comprised of ferrite with an area fraction of 10 to 85% and residual austenite with a volume fraction of 1 to 10%, an area fraction of 10% to 60% of tempered martensite, and a balance of bainite.

2. A method of production of high strength thin-gauge steel sheet with excellent elongation and hole expandability characterized by, producing a slab comprised of by mass %, C: 0.03 to 0.25%, Si: 0.013 to 0.299%, Mn: 0.8 to 3.1%, P≦0.02%, S≦0.02%, Al≦2.0%, and N≦0.01% and, further, when necessary, one or more types of V: 0.005 to 1%, Ti: 0.002 to 1%, Nb: 0.002 to 1%, Cr: 0.005 to 2%, Mo: 0.005 to 1%, B: 0.0002 to 0.1%, Mg: 0.0005 to 0.01%, REM: 0.0005 to 0.01%, and Ca: 0.0005 to 0.01%, and a balance of Fe and unavoidable impurities, followed by heating to a range of 1150 to 1250° C., then hot rolling in a temperature range of 800 to 950° C., coiling at 700° C. or less, then pickling, then cold rolling by a reduction rate of 30 to 80%, then in a continuous annealing process, soaking at 600° C. to the $Ac_3$ point+50° C. for recrystallization annealing, cooling by an average cooling rate of 10 to 150° C./s to a first cooling end temperature of 400° C. or less, then heating and holding at a first holding temperature higher than the first cooling end temperature and within the range of 150 to 400° C. for 1 to 20 minutes, then cooling to a second cooling end point temperature of the martensitic transformation point or less, then heating and holding at a second holding temperature within the range of the second cooling end temperature to 500° C. for 1 to 100 seconds, then cooling, to thereby obtain a metal structure having a microstructure comprised of ferrite with an area fraction of 10 to 85% and residual austenite with a volume fraction of 1 to 10%, an area fraction of 10% to 60% of tempered martensite, and a balance of bainite.

* * * * *